US006695290B1

(12) United States Patent
O'Connell

(10) Patent No.: US 6,695,290 B1
(45) Date of Patent: Feb. 24, 2004

(54) LIFTING JACK ACCESSORY

(76) Inventor: Timothy E. O'Connell, 2712 Pillsbury Rd., Chico, CA (US) 95973

( * ) Notice: Subject to any disclaimer, the term of this patent is extended or adjusted under 35 U.S.C. 154(b) by 0 days.

(21) Appl. No.: 09/430,390

(22) Filed: Oct. 29, 1999

(51) Int. Cl.[7] ..... B66F 3/00
(52) U.S. Cl. ..... 254/133 R; 254/134
(58) Field of Search ..... 269/147, 88, 6; 254/133 R, 134, 108–111, 93 R

(56) References Cited

U.S. PATENT DOCUMENTS 761,413 A 5/1904 Schroer
859,924 A 7/1907 Davis
879,673 A 2/1908 Reardon
911,638 A 2/1909 Allgeo
927,067 A * 7/1909 Oppineer ..... 269/147
958,777 A 5/1910 Shipman
1,087,879 A 2/1914 Harrah
1,104,328 A 7/1914 Sutton
1,107,039 A 8/1914 Coleman et al.
1,179,825 A 4/1916 Greutmann et al.
1,321,950 A 11/1919 Templeton
1,325,963 A 12/1919 Templeton
1,325,964 A 12/1919 Templeton
1,374,653 A 4/1921 Harrah
1,410,380 A 3/1922 Daniels
1,465,895 A 8/1923 Daniels
1,482,846 A 2/1924 Harrah
2,031,815 A 2/1936 Berman
2,165,366 A 7/1939 Gormley
2,616,665 A * 11/1952 Alton ..... 254/133 R
2,620,011 A * 12/1952 Zinke ..... 269/147
2,786,650 A 3/1957 Bottorff
3,012,755 A 12/1961 Acklin
3,091,432 A * 5/1963 Chartier ..... 269/147
3,300,184 A 1/1967 Ragolio
3,452,575 A 7/1969 Williams et al.
3,831,892 A 8/1974 Herman
3,841,604 A 10/1974 Haynes
3,991,977 A 11/1976 Penttila
4,061,168 A 12/1977 Fariss, Jr.
D248,460 S 7/1978 Dunn et al.
4,203,578 A 5/1980 Margueratt
4,379,546 A 4/1983 McIntosh
4,564,173 A 1/1986 Atherton et al.
4,568,064 A 2/1986 Reinhardt
4,616,970 A * 10/1986 Lewis ..... 254/134
4,736,927 A * 4/1988 Clancy ..... 254/93 R
4,953,606 A 9/1990 Brown, Jr.

OTHER PUBLICATIONS

Jackall Products product brochure "Jackall 8000 Series", entire brochure printed from the internet, Jun. 30, 1999.

* cited by examiner

*Primary Examiner*—Lee D. Wilson
(74) *Attorney, Agent, or Firm*—Bernhard Kreten

(57) ABSTRACT

An accessory for use in lifting jacks which is fixed to the standard of the jack and includes a plurality of accessories for enhancing the versatility of the lifting jack. Pulling and pushing instrumentalities can be oriented on the accessory to enhance the versatility of the lifting jack or the accessory can be used in lieu of a support platform where its downwardly extending spikes can penetrate into soft supporting material to provide increased hold of the standard.

15 Claims, 8 Drawing Sheets

LIFTING JACK ACCESSORY

FIELD OF THE INVENTION

The following invention relates generally to an instrumentality which operatively couples to a conventional lifting jack to transform the jack from a device which merely lifts vehicles, typically for changing flat tires, to a multi-purpose accessory.

BACKGROUND OF THE INVENTION

Lifting jacks, sometimes referred to as bumper jacks, are in fairly common use. Typically, a lifting jack includes an elongate perforated standard over which a ratcheting mechanism is disposed, and the ratcheting mechanism includes a load engaging nose. A handle, operatively coupled to the ratcheting mechanism allows the nose to move along the length of the standard. Over the course of the years, people have sought to diversify the manner in which a lifting jack can be used to find utility in areas other than its use as a bumper jack.

The following prior art reflects the state of the art of, which applicant is aware and is included herewith to discharge applicant's acknowledged duty to disclose relevant prior art. It is respectfully stipulated, however, that none of these patents or prior art publications teach or in any way render obvious the nexus of the invention as set forth hereinafter.

| PATENT NO. | ISSUE DATE | INVENTOR |
|---|---|---|
| 761,413 | May 31, 1904 | Schroer |
| 859,924 | Jul. 16, 1907 | Davis |
| 879,673 | Feb. 18, 1908 | Reardon |
| 911,638 | Feb. 9, 1909 | Allgeo |
| 958,777 | May 24, 1910 | Shipman |
| 1,087,879 | Feb. 17, 1914 | Harrah |
| 1,104,328 | Jul. 21, 1914 | Sutton |
| 1,107,039 | Aug. 11, 1914 | Coleman, et al. |
| 1,179,825 | Apr. 18, 1916 | Greutmann, et al. |
| 1,321,950 | Nov. 18, 1919 | Templeton |
| 1,325,963 | Dec. 23, 1919 | Templeton |
| 1,325,964 | Dec. 23, 1919 | Templeton |
| 1,374,653 | Apr. 12, 1921 | Harrah |
| 1,410,380 | Mar. 21, 1922 | Daniels |
| 1,465,895 | Aug. 21, 1923 | Daniels |
| 1,482,846 | Feb. 5, 1924 | Harrah |
| 2,031,815 | Feb. 25, 1936 | Berman |
| 2,165,366 | Jul. 11, 1939 | Gormley |
| 2,786,650 | Mar. 26, 1957 | Bottorff |
| 3,012,755 | Dec. 12, 1961 | Acklin |
| 3,300,184 | Jan. 24, 1967 | Ragolio |
| 3,452,575 | Jul. 1, 1969 | Williams, et al. |
| 3,831,892 | Aug. 27, 1974 | Herman |
| 3,841,604 | Oct. 15, 1974 | Haynes |
| 3,991,977 | Nov. 16, 1976 | Penttila |
| 4,061,168 | Dec. 6, 1977 | Fariss, Jr. |
| Des. 248,460 | Jul. 11, 1978 | Dunn, et al. |
| 4,203,578 | May 20, 1980 | Margueratt |
| 4,379,546 | Apr. 12, 1983 | McIntosh |
| 4,564,173 | Jan. 14,1986 | Atherton, et al. |
| 4,568,064 | Feb. 4, 1986 | Reinhardt, |
| 4,953,606 | Sept. 4, 1990 | Brown, Jr. |

OTHER PRIOR ART (Including Author, Title, Date. Pertinent Pages, Etc.)

Jackall Products product brochure "Jackall 8000 Series", entire brochure printed from the internet, Jun. 30, 1999

When a lifting jack is to be used as a bumper jack, it typically is provided with a platform at its lowermost surface to engage the ground and provide a stable platform as the lifting jack is utilized to raise the car. However, if the car is being elevated at an area other than its center point, the lifting jack experiences a load which is not truly vertical and it is possible for a bumper jack to experience severe angulation and a force vector not axially aligned with the standard causing the bumper jack to slip, creating a hazardous situation. In addition, bumper jacks suffer from further instability when being deployed upon ice, irregular surfaces, and surfaces which are yielding (i.e., something other than pavement, like sand, gravel, mud, etc.). The accessory associated with the instant invention not only provide enhanced performance in these areas where the lifting jack has known shortcomings, but also lends itself to utilization in a multiplicity of other ways for providing added flexibility to the lifting jack.

SUMMARY OF THE INVENTION

The instant invention is distinguished over the known prior art in a multiplicity of ways. The accessory is configured as a sleeve, which is dimensioned to slideably overlie the standard of a conventional lifting jack and can move along the length of the standard, since its inner diameter provides clearance for the standard to move therewithin with minimal friction. Once located on the standard at an appropriate spot, the accessory can be fixed into position on the standard by means of a pair of holes which are axially aligned and pass through the sleeve. A locking pin is dimensioned to project through the holes on the sleeve and through a perforation commonly found on the lifting jack so that the position of the accessory is fixed on the standard. The sleeve has opposite first and second ends. The first end includes a purchase area which lends itself to work in concert with the nose on the ratcheting mechanism of the lifting jack to provide loads either in compression or tension. The second opposite end of the accessory includes a plurality of spikes so that when the accessory is located at an extremity of the standard, the spikes provide enhanced stability when engaging soft materials, thereby providing a more secure grip of the lifting jack at that area.

OBJECTS OF THE INVENTION

A primary object of the present invention is to provide a new and novel accessory for a lifting jack.

A further object of the present invention is to provide a device as characterized above which is easy to use, extremely safe and lends itself to mass production techniques.

A further object of the present invention is to provide a device as characterized above which can provide compressive and tensile loading.

A further object of the present invention is to provide a device as characterized above which includes a support area having a plurality of spikes which enhance the stability of the device when used in conjunction with a lifting jack.

Viewed from a first vantage point, it is an object of the present invention to provide a lifting jack accessory in which the lifting jack includes an elongate, perforated standard, a ratcheting mechanism overlying the standard, the ratcheting mechanism including a load engaging nose operatively coupled to a ratcheting handle, the accessory comprising, in combination: a sleeve dimensioned to slideably overlie the standard and translate along a length of the standard, a pair of holes, axially aligned and passing through the sleeve, a pin dimensioned to project through the holes to fix the sleeve on the standard by the pin passing through one perforation of the standard, a purchase area at a first end of the sleeve, and a plurality of spikes at a second end of the sleeve.

These and other objects will be made manifest when considering the following detailed specification when taken in conjunction with the appended drawing figures.

DESCRIPTION OF PREFERRED EMBODIMENTS

Figure 1:
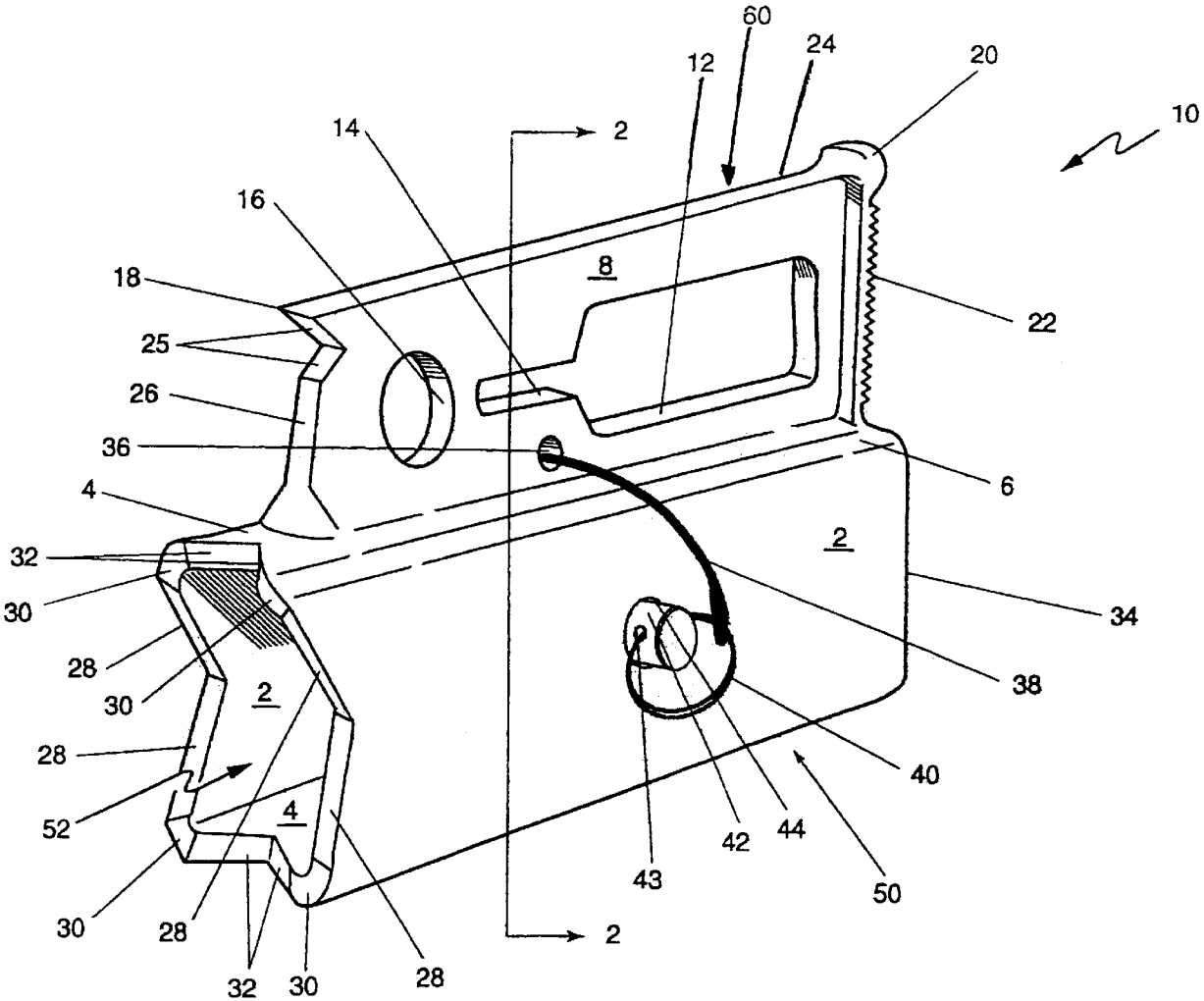
FIG. 1 is a perspective view of the apparatus according to the present invention.

Referring to the drawings, wherein like reference numerals denote like parts throughout the various drawing figures, reference numeral 10 is directed to the accessory for a lifting jack according to the present invention.

In its essence, the accessory 10 includes a sleeve 50 integrally formed with an implement adjunct 60 thereto.

Figure 2:
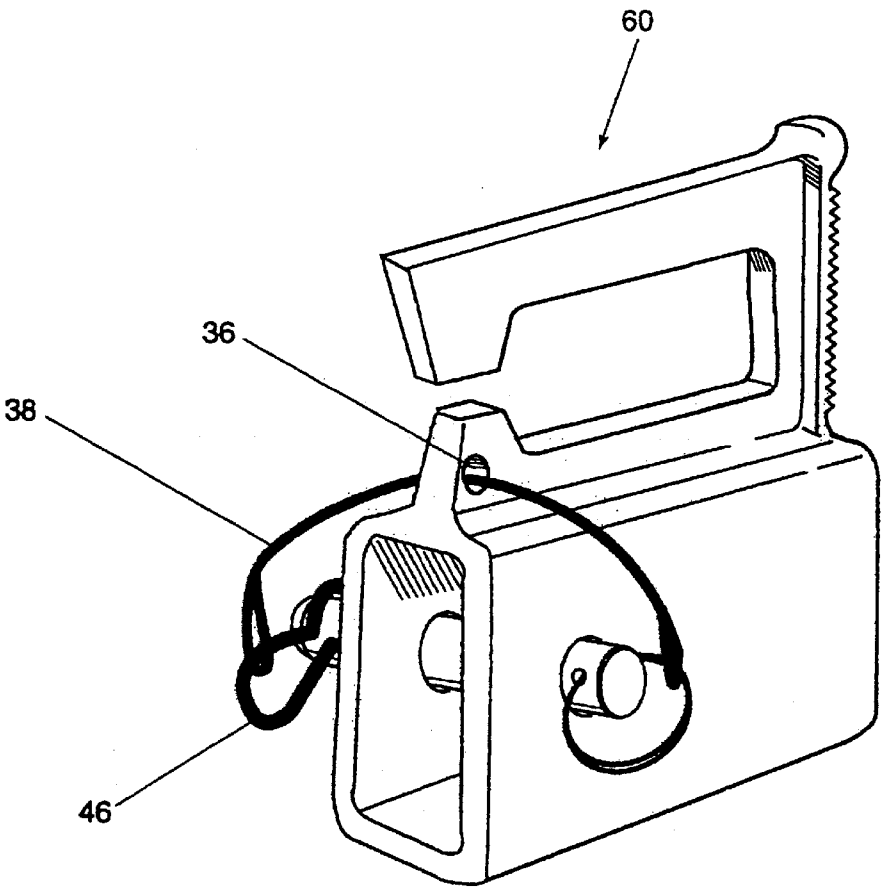
FIG. 2 is a sectional view along lines 2—2 of FIG. 1 indicating the cooperation of a locking pin in association with the device according to the present invention.

More particularly, the sleeve 50 is formed as a hollow construct having four sides, a first and second wide side 2 each held in parallel spaced relationship and bounded at extremities by spaced parallel narrow sides 4. The juncture between all sides is preferably provided with radiused corners 6 so that a smooth contour is provided. The hollow 52 that is defined by the peripheral wide and narrow sides 2, 4, respectively, is dimensioned to receive a standard which is a common feature on conventional lifting jacks. Lifting jacks typically include a plurality of holes along the length of the standard. These hollows allow the sleeve 50 to be located along the length of the standard by virtue of holes 44 which pass through each of the wide sides 2. The holes 44 are axially aligned to allow a quick release pin 42 to pass therethrough. The quick release pin 42 is constrained to stay on the accessory 10 by means of a lanyard 38 having a first end which connects to a first end of the pin 42 via a pin aperture 43 which receives a circular locking clip 40. The second end of the lanyard, shown in. FIG. 2 attaches to a removeable positive locking clip 46 which passes through a complementarily formed aperture 43 on a second end of pin 42 so that collectively the pin, clip, lanyard assembly retains the sleeve in fixed position on the standard. The lanyard 38 is retained on the adjunct 60 by being threaded through a lanyard retaining fenestration 36.

One of the narrow sides 4 supports the integrally formed normally projecting adjunct 60. The adjunct 60 is formed as a wall 8 which includes a purchase area at one extremity that includes a rounded nose 20*a* (FIGS. 1 and 1C) and a plurality of teeth 22. The remote extremity of the adjunct includes at least one spike 18 formed adjacent a notch 25 (preferably V-shaped) that transitions to the narrow side 4 by means of a shoulder 26. Spike 18 serves as a fixture spur. A surface 24 that extends from the nose 20 to the spike 18 has a flat sloped contour that narrows as it extends from the nose 20 to the spike 18. The nose 20*a* is preferably contoured as having a rounded periphery as shown in FIG. 1C. The nose could terminate in an edge coplanar with surface 24 and having a widened "chisel" head 20*c* (FIG. 1A) or a spike, such as 18. FIG. 1D reflects a "chisel" head transverse to the FIG. 1B version with the chisel head 20*b* facing away from the device 10. Somewhat in the same plane as teeth 22.

The adjunct 60 also includes a clevis hole 16 which provides a convenient attachment point for rigging shackles as will be explained. In addition, the adjunct 60 includes a chain slot having a wide rectangular hollow 12 to receive the chain and a narrowed chain lock 14 with a depth comparable to a chain link's thickness. The chain slot 12 is shown closer to teeth 22 than clevis hole 16. Both are centrally located on wall 8.

The sleeve 50 has at one extremity (FIG. 1B) four spikes 30 preferably having flattened ends all lying in a horizontal plane and at corners of sleeve 50 to provide secure footing when this end is placed on a support surface. The flattened, spikes 30 are interrupted one from the other by means of "V" shaped canted walls, a pair of long canted walls 28 on the wide sides 2 and smaller canted walls 32 on the narrow sides 4.

Figure 1A:
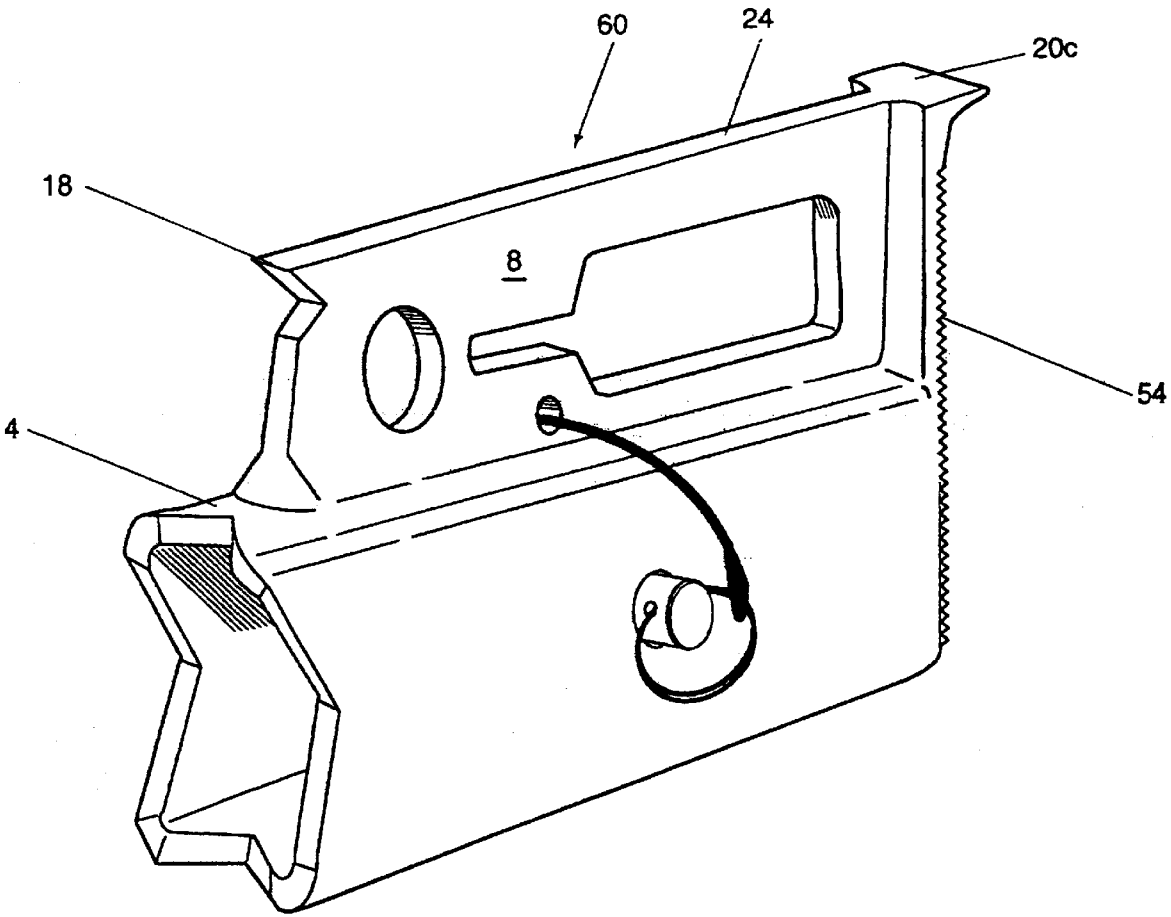
FIG. 1A is an alternative to that which is shown in FIG. 1.
Figure 1C:
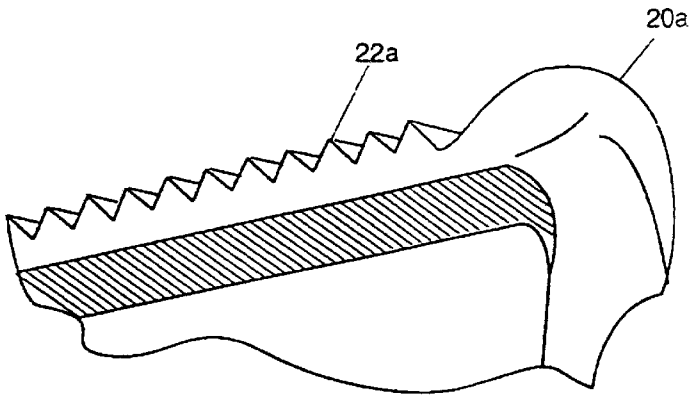
FIG. 1C details one configuration of teeth.
Figure 1D:
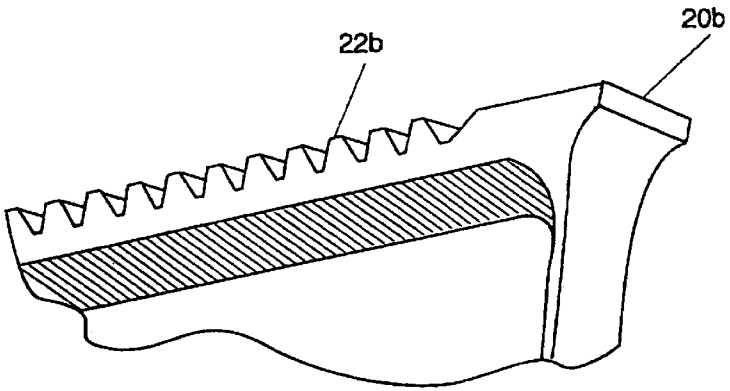
FIG. 1D details another configuration of teeth.
Figure 1B:
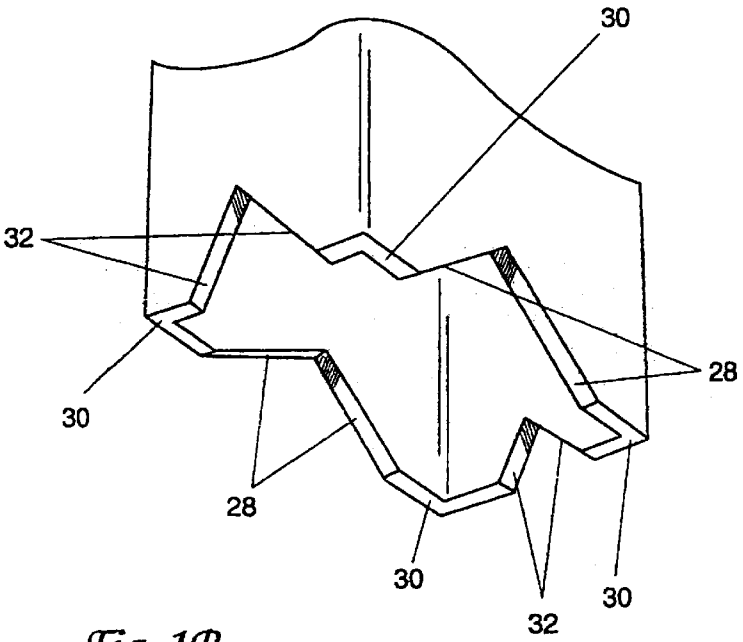
FIG. 1B details one end of FIG. 1.

FIG. 1 shows a version in which the opposite end from the spikes has a flattened surface 34. FIG. 1A shows a version in which the serrated teeth 22 of FIG. 1 extend along the entire face and bear the reference numeral 54. Note also that the teeth all lie in the same plane in the FIG. 1A version. FIG. 1C shows teeth 22*a* which come to a point. FIG. 1D shows flattened teeth 22*b* and a pointed nose 20*b* (FIGS. 1A and 1D).

In use and operation, and considering FIGS. 3 through 7, various illustrative forms of manipulation of the accessory 10 can be explored. These examples are not exhaustive of possible uses.

Figure 3:
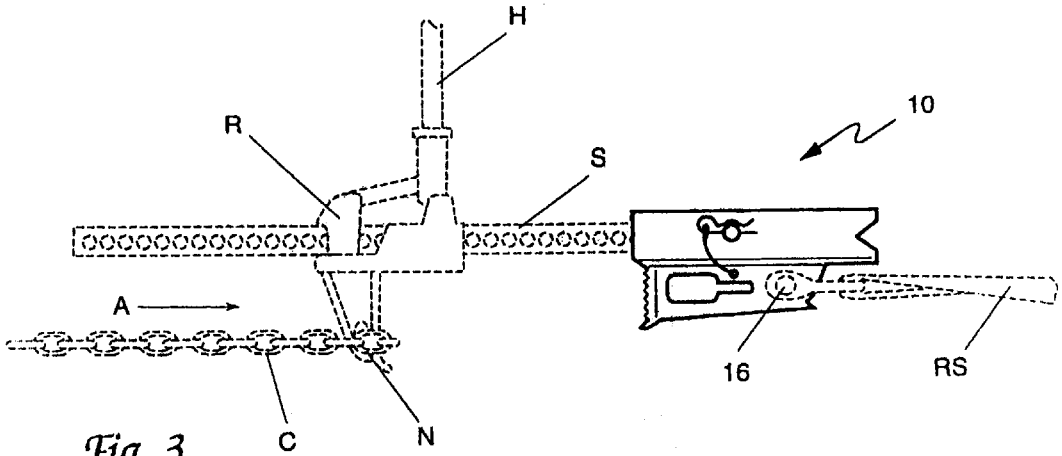
FIG. 3 shows the device in use on a lifting jack performing one manipulation.

In FIG. 3, the standard S fixes the accessory 10 thereon by means of the pin 42 discussed above. A rigging shackle RS is fastened to the clevis hole 16. The ratcheting mechanism R and handle H of the conventional jack is located as shown to the left of the drawing in FIG. 3 and the nose N receives a chain C thereabout. Cranking the handle H can pull the chain C in the direction of the arrow A with the standard S firmly held by the accessory 10.

Figure 4:
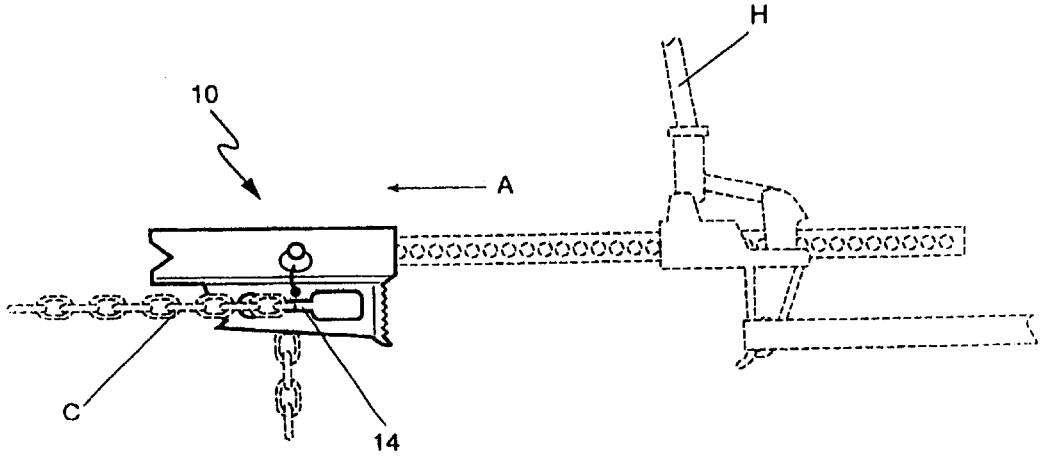
FIG. 4 shows the device in association with a lifting jack providing a second type of manipulation.

In FIG. 4, the chain C includes one link received in the chain lock 14. The handle H, when manipulated, will cause the standard to move in the direction of the arrow A moving the accessory 10 therewith since it is locked onto the standard.

Figure 5:
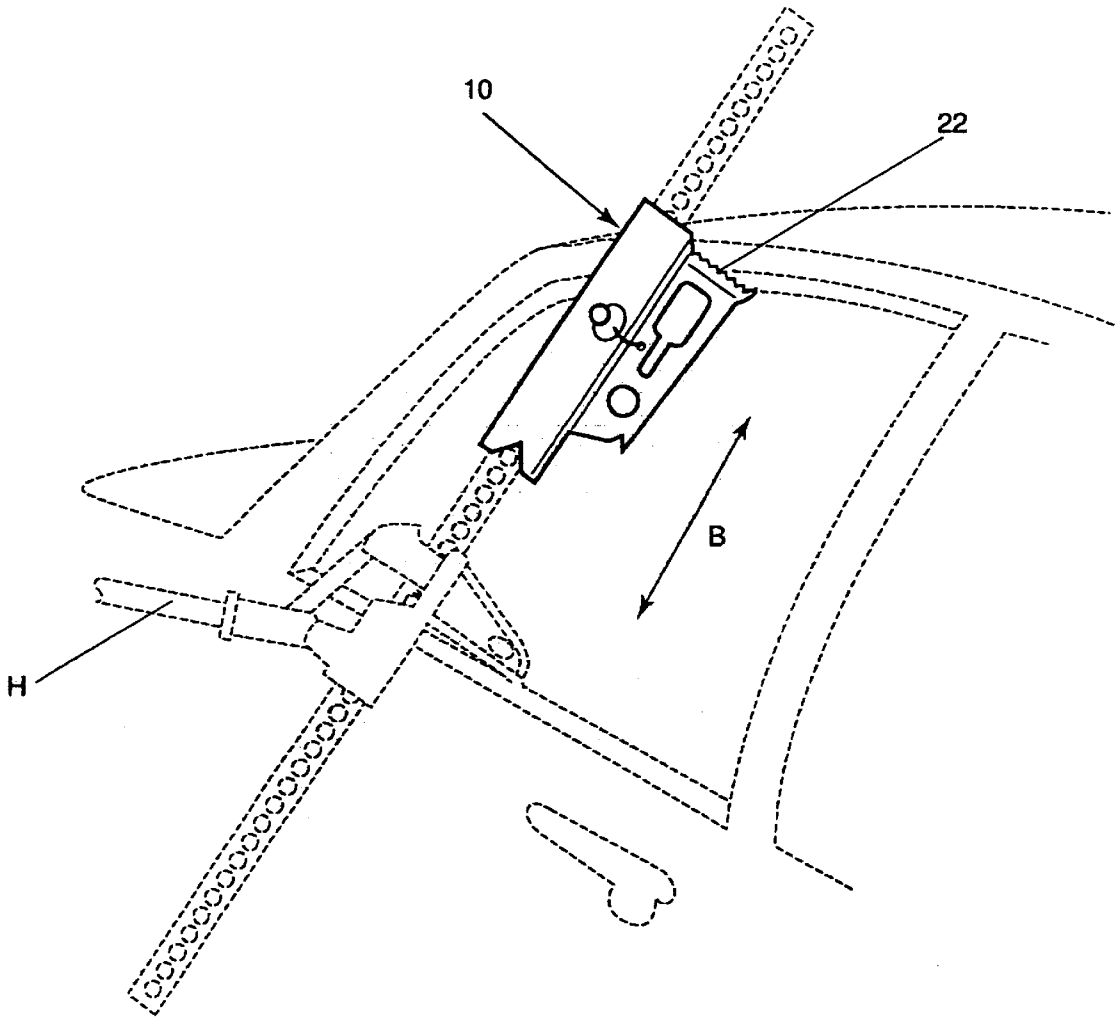
FIG. 5 shows the device according to the present invention being used in an emergency situation accessing a car door.

FIG. 5 reflects an emergency situation in which it is desired to force a door. In this context, the accessory 10 is oriented such that the teeth 22 are located on one edge of a door of a vehicle. By moving the handle H on the jack, a force is provided along the double ended arrows B on the window periphery.

Figure 6:
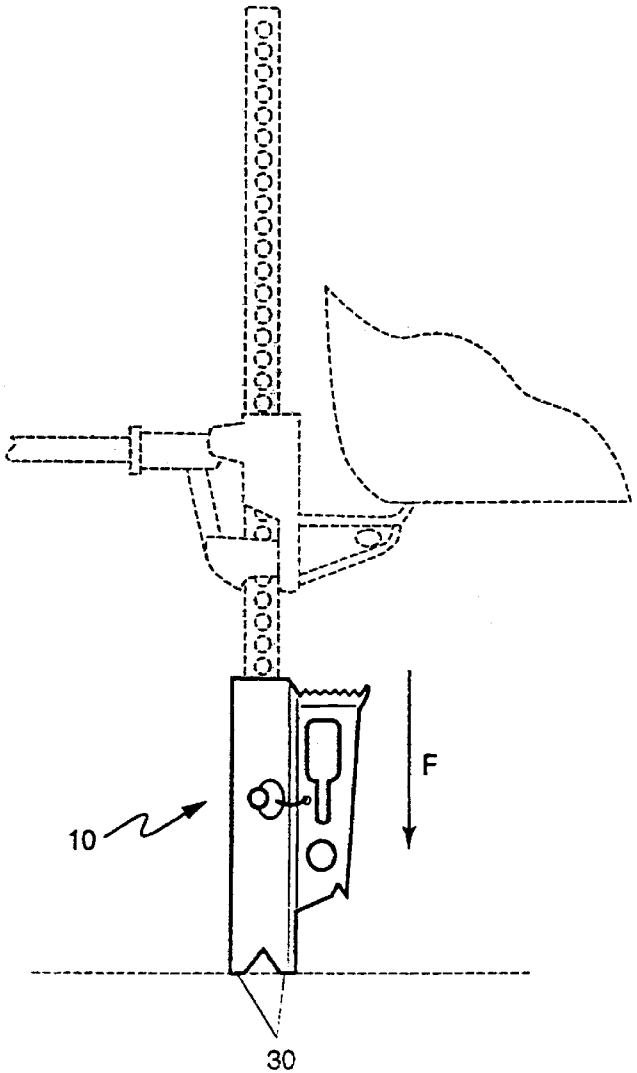
FIG. 6 shows the apparatus used in another configuration in conjunction with its use as a bumper jack.

With respect to FIG. 6, the accessory 10 is fixed on the standard as explained above with the flattened spikes 30 engaging the ground. Where the surfaces is yielding, the spike will provide an increased grip as a downward force F is exerted. The penetration of the spikes 30 into the ground provides a more stable contact with the ground.

Figure 7:
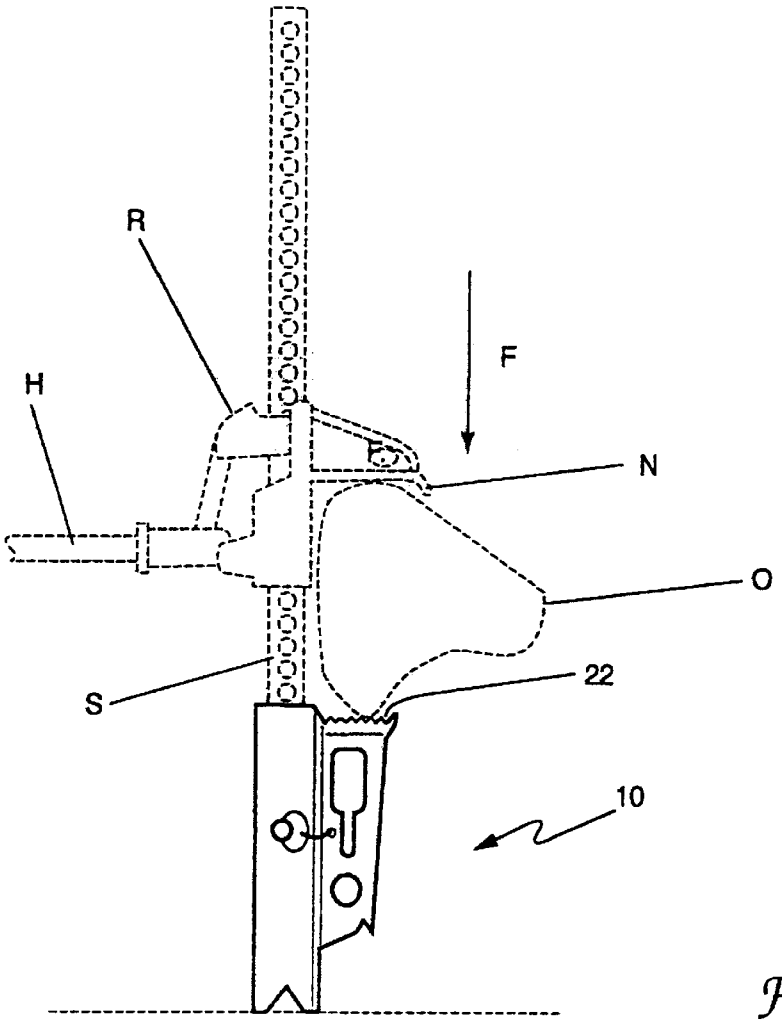
FIG. 7 shows the device in a further configuration in which a compressive load is being provided.

FIG. 7 shows an embodiment in which the accessory 10 is fixed on the standard S and the jack handle H is manipulated to provide a force F on an object interposed between the nose N of the ratcheting mechanism and the teeth 22 of the accessory 10. The compressive force will be exerted on the object O interposed therebetween.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A lifting jack accessory in which the lifting jack includes an elongate, perforated standard, a ratcheting mechanism overlying the standard, the ratcheting mechanism including a load engaging nose operatively coupled to a ratcheting handle, said accessory comprising, in combination:

a sleeve dimensioned to slideably overlie the standard and translate along a length of the standard, a pair of holes, axially aligned and passing through said sleeve, a pin dimensioned to project through said holes to fix said sleeve on the standard by said pin passing through one perforation of the standard, a purchase area at a first end of said sleeve, and a plurality of spikes at a second end of said sleeve.

2. A lifting jack accessory in which the lifting jack includes an elongate, perforated standard, a ratcheting mechanism overlying the standard, the ratcheting mechanism including a load engaging nose operatively coupled to a ratcheting handle, said accessory comprising, in combination:

a sleeve dimensioned to slideably overlie the standard and translate along a length of the standard, a pair of holes, axially aligned and passing through said sleeve, a pin dimensioned to project through said holes to fix said sleeve on the standard by said pin passing through one perforation of the standard, a purchase area at a first end of said sleeve, and a plurality of spikes at a second end of said sleeve, further including an adjunct projecting from a side of said sleeve, said adjunct including means for engaging other objects therewith.

3. The accessory of claim 2 wherein said adjunct includes a clevis hole for receiving shackle rigging.

4. The accessory of claim 2 wherein said adjunct includes a chain lock means.

5. The accessory of claim 4 wherein said chain lock means includes a rectangular hollow passing through a wall of said adjunct in communication with a chain slot portion dimensioned to receive one chain's thickness therein defining said chain lock.

6. The accessory of claim 2 including a nose on said adjunct on one end thereof.

7. The accessory of claim 6 including a spike on said adjunct at a remote end thereof.

8. The accessory of claim 2 including a plurality of teeth on one surface of said adjunct.

9. The accessory of claim 2 including a plurality of teeth on said sleeve.

10. The accessory of claim 2 including a lanyard attached to said pin and threaded through a fenestration on said adjunct for retaining said pin on said accessory, and a locking clip at an end of said lanyard for attaching and fixing said pin thereto.

11. The accessory of claim 2 including a plurality of teeth on said sleeve.

12. A lifting jack accessory comprising, in combination:

a sleeve having first and second ends and an adjunct projecting from a side of said sleeve including means for engaging other objects therewith, wherein said adjunct includes a chain lock means.

13. The accessory of claim 12 wherein said chain lock means includes a rectangular hollow passing through a wall of said adjunct in communication with a chain slot portion dimensioned to receive one chain's thickness therein defining said chain lock.

14. A lifting jack accessory in which the lifting jack includes an elongate, perforated standard, a ratcheting mechanism overlying the standard, the ratcheting mechanism including a load engaging nose operatively coupled to a ratcheting handle, said accessory comprising, in combination:

a sleeve having first and second ends and an adjunct projecting from a side of said sleeve including means for engaging other objects therewith, wherein said sleeve overlies the standard, and wherein said sleeve includes a pair of holes through which a pin is removeably attached, said pin passing through the standard.

15. The accessory of claim 14 including a lanyard attached to said pin and threaded through a fenestration on said adjunct for retaining said pin on said accessory, and a locking clip at an end of said lanyard for attaching and fixing said pin thereto.

* * * * *